United States Patent [19]
Kreeger et al.
[11] 4,402,408
[45] Sep. 6, 1983

[54] MULTILEVEL STACKING CONTAINER

[75] Inventors: Elsmer W. Kreeger, Allegan; Edward L. Stahl, Brighton, both of Mich.

[73] Assignee: Pinckney Molded Plastics, Inc., Pinckney, Mich.

[21] Appl. No.: 380,520

[22] Filed: May 21, 1982

[51] Int. Cl.³ ..... B65D 21/04
[52] U.S. Cl. ..... 206/507
[58] Field of Search ..... 206/505, 506, 507

[56] References Cited

U.S. PATENT DOCUMENTS

| | | | |
|---|---|---|---|
| 3,870,151 | 3/1975 | Johnson | 206/507 |
| 3,937,327 | 2/1976 | Carroll | 206/507 |
| 4,023,680 | 5/1977 | Thurmann | 206/507 |
| 4,106,623 | 8/1978 | Carroll et al. | 206/507 |
| 4,106,624 | 8/1978 | Thurmann | 206/507 |
| 4,106,625 | 8/1978 | Carroll et al. | 206/507 |
| 4,189,052 | 2/1980 | Carroll et al. | 206/507 |
| 4,334,616 | 6/1982 | Wilson | 206/507 |
| 4,343,400 | 8/1982 | Faucillion | 206/507 |

*Primary Examiner*—George E. Lowrance
*Attorney, Agent, or Firm*—Basile, Weintraub & Hanlon

[57] ABSTRACT

A multilevel stacking container having opposed end walls of complementary configuration such that one container may be stacked upon a like container at a first level in a like end to like end relationship and stacked at a second level in a like end to complementary end relationship. The end walls are so configured as to accommodate transverse sliding of the upper container laterally across the lower container into either of the aforementioned stacked relationships without snagging prior to final vertical alignment. Abutment means are operable to maintain the stacked containers against movement out of vertical alignment once in a stacked relationship.

As employed in the following claims, the word "coextensive" is to be construed as meaning in alignment—laterally or transversely of the container—that is, elements on opposite end walls of the container are "coextensive" with each other when they are located at equal distances from one of the container side walls (even though the element on one end wall may be vertically offset from the other "coextensive" element).

4 Claims, 15 Drawing Figures

MULTILEVEL STACKING CONTAINER

BACKGROUND OF THE INVENTION

The present invention is directed to a multilevel stacking container of a type frequently used in the distribution of bakery products. Containers of this general type are designed to stack upon each other in a stable stack both for storage and for convenience in handling during the delivery operation. Conventionally such containers are also designed so that one container may be stacked at two or more different levels with respect to the underlying supporting container to minimize the height of a stack while affording adequate clearance to prevent crushing of the products carried in the lower containers. High-level stacking may be desired for products such as loaves of bread, while a somewhat lower-level stacking may be adequate for products of lesser height, such as cupcakes for example.

There is a substantial body of prior art relating to containers of this general type, see, for example, U.S. Pat. Nos. 3,937,327; 4,106,623; 4,106,625; and 4,189,052. The present invention is especially directed to improvements in containers of this type, particularly containers which are formed with end walls of differing, but complementary, configuration in which high-level stacking is achieved with one end wall relationship (i.e., like end wall to like end wall) and a lower-level stacking relationship is established by reversing the end wall relationship (i.e., like end wall to complementary end wall).

In most cases this last-mentioned type of design finds the end walls being formed with raised and lowered sections so arranged as to achieve the two-level stacking by selectively employing the like or reverse orientation between the container end walls. See, for example, U.S. Pat. No. 4,189,052. However, in achieving this result, prior art containers usually require the container being stacked to be manually lifted into vertical alignment with the underlying container and then being manually lowered vertically into stacked relationship. In handling these containers, it is frequently attempted to slide the upper container across the lower container to its stacked position; however, the alternate raised and lowered sections on the two containers frustrate this movement by snagging or interfering with each other before the upper container reaches its final stacked position.

The present invention is especially directed to an end wall configuration in which the foregoing problem is eliminated.

SUMMARY OF THE INVENTION

In accordance with the present invention, a first end wall of the container is formed with a vertical inner web whose upper edge is defined by alternate raised and lowered horizontal edge sections. A lower outer web on the first end wall has a lower edge formed by corresponding horizontal raised and lowered edge sections, the raised sections of the outer web lower edge being coextensive or longitudinally aligned with the lower edge sections of the inner web. The opposite end wall is similarly formed, but is complementary in configuration—that is, the raised edge sections of the complementary end wall are coextensive, that is, in opposed alignment, with the corresponding lower edge sections of the first end wall.

Thus, when two of these containers are stacked in a like end to like end relationship, the lower portions of the lower web are aligned with the raised portions of the upper web of the underlying container to establish a high-level stacked position. When the orientation of the containers is reversed 180 degrees so that a like web to unlike or complementary web relationship exists, the lowered portions of the lower edges of the upper container match up with the lowered portions of the upper edge of the lower container to establish a low-level stacking relationship.

To accommodate sliding movement of one container transversely across the top of another to the stacked position without interference or snagging, relatively thin vertical posts project upwardly from the lowered portion of the upper edge of one end wall midway of the longitudinal extent of this lowered edge portion. The top of this post will engage the lowered portions of the lower edge of a like container being slid into position to prevent snagging or dropping of the last-mentioned lower edge into the recess. Complementary vertical slots are formed in the lower edge of the opposed end wall to receive these posts to accommodate movement of the upper of two containers to the low-level stacking position in the like end to complementary end configuration where the two containers are finally aligned.

An abutment rail near each end of the container on the underside of the bottom is provided with vertical end abutment surfaces which snugly seat between two post sections formed at opposite ends of each end wall to require a slight lifting movement of the uppermost of two containers to remove the uppermost container from stacked relationship. This rail also assists in the sliding of the upper container into final alignment.

Other objects and features will become apparent by reference to the following specification and to the drawings.

IN THE DRAWINGS

Figure 1:
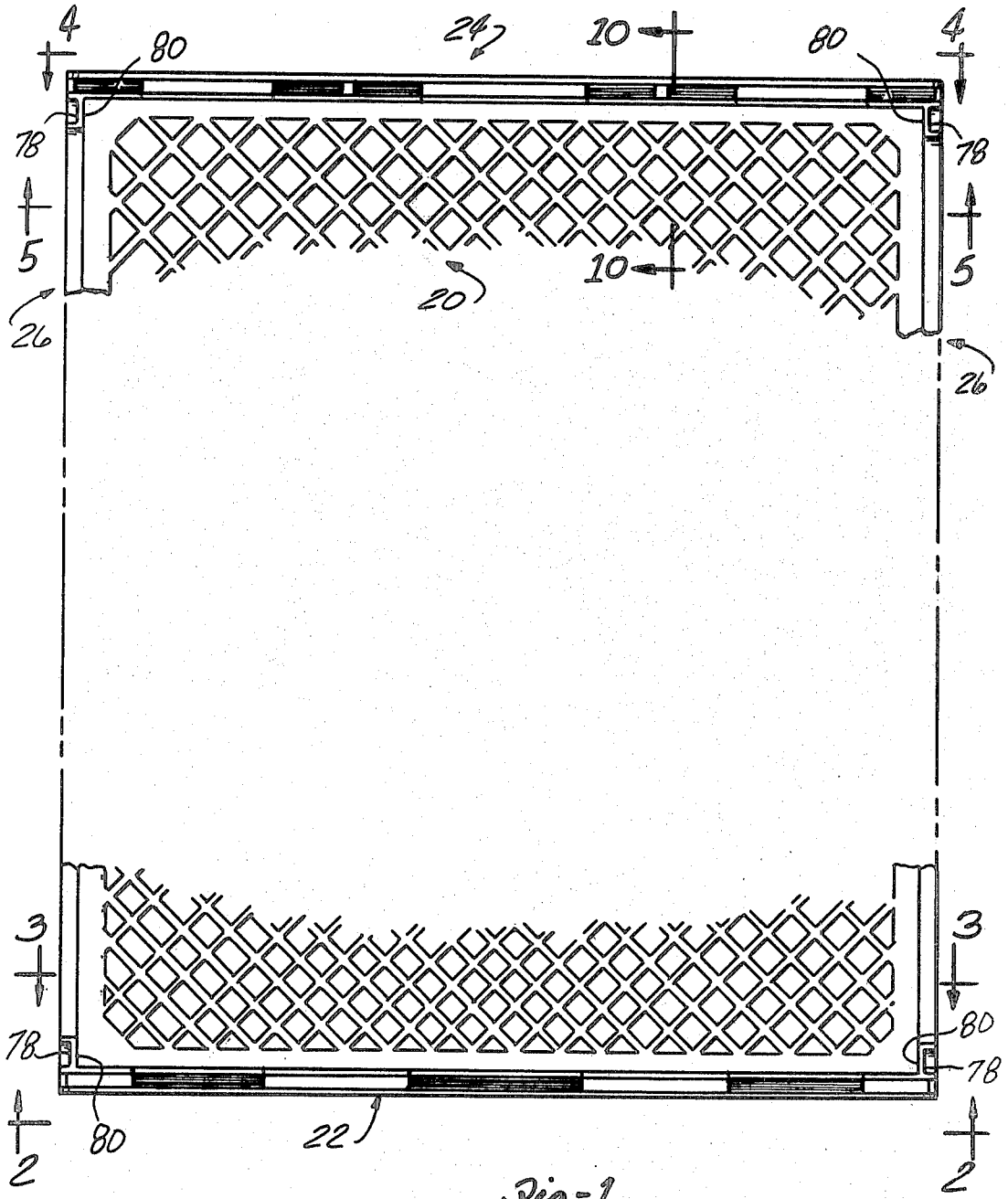
FIG. 1 is a plan view, with certain parts broken away of a container embodying the present invention.

Referring first to FIG. 1, a container embodying the present invention includes a bottom designated generally 20 of rectangular configuration having first 22 and second 24 end walls fixedly secured to and projecting upwardly from opposite ends of bottom 20. Side walls designated generally 26 are fixedly secured to the opposite side edges of bottom 20 and to end walls 22 and 24. The bottom, end walls and side walls described above are preferably formed of a suitable thermoplastic material, such as polypropylene, and formed into a unitary, one-piece structure.

Figure 9:
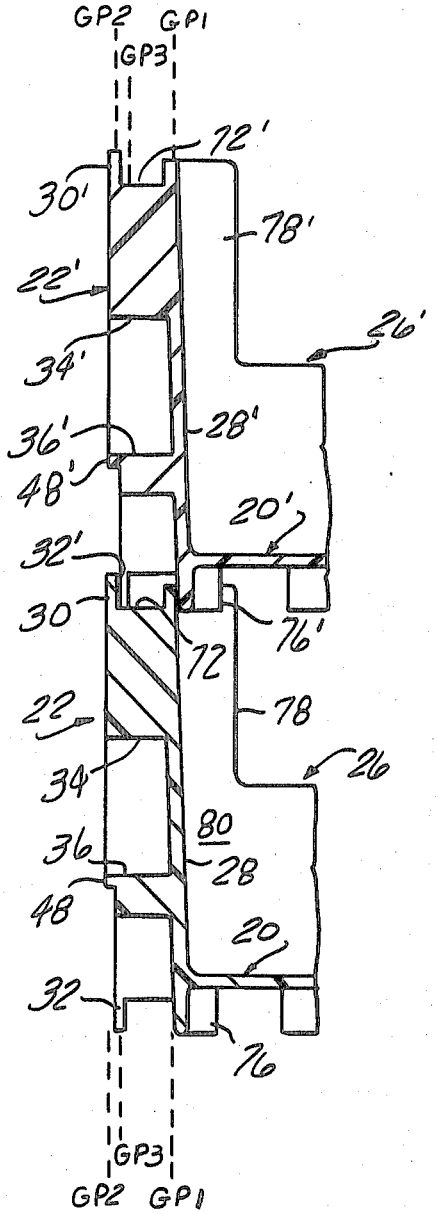
FIG. 9 is a detailed cross-sectional view taken approximately at the location 9—9 of FIG. 1 showing two containers stacked in a like end wall to like end wall relationship in a high-level stacking position.
Figure 10:
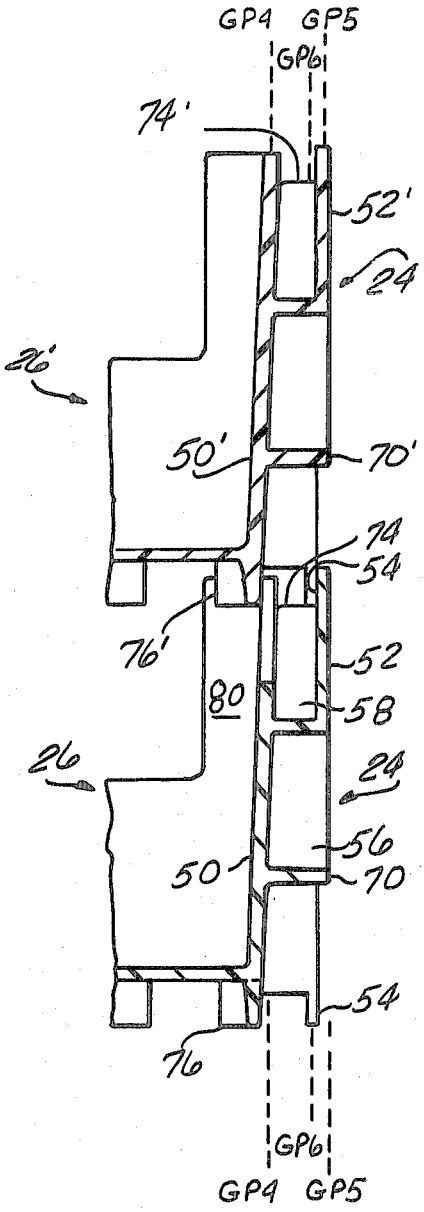
FIG. 10 is a detailed cross-sectional view taken approximately at the location 10—10 of FIG. 1 showing the opposite end wall relationship of two containers stacked in like end to like end, high-level stacking relationship.
Figure 11:
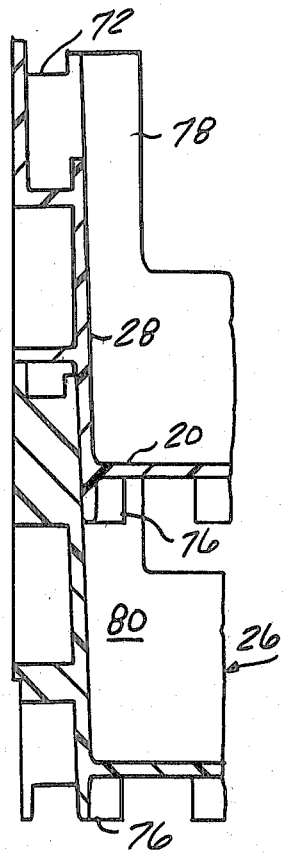
FIGS. 11 and 12 are cross-sectional views corresponding respectively to FIGS. 9 and 10, showing two containers stacked in like end to complementary end, low-level stacking relationship.
Figure 12:
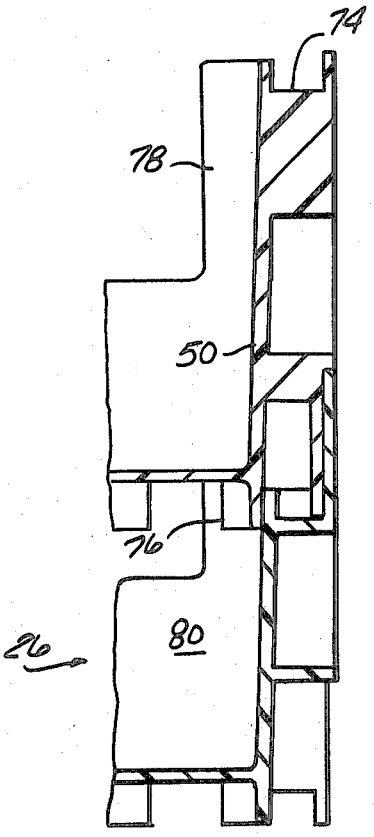

The objectives of the present invention are primarily achieved by the structure of end walls 22 and 24 which are best seen in FIGS. 2–5 complemented by the cross-sectional views of FIGS. 9 and 10.

Figure 2:
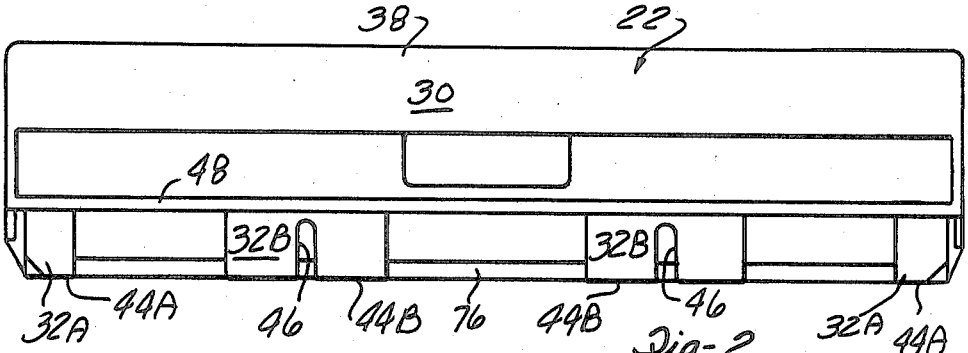
FIG. 2 is a side elevational view of a first end wall of the container of FIG. 1, taken from the plane 2—2 of FIG. 1.
Figure 3:
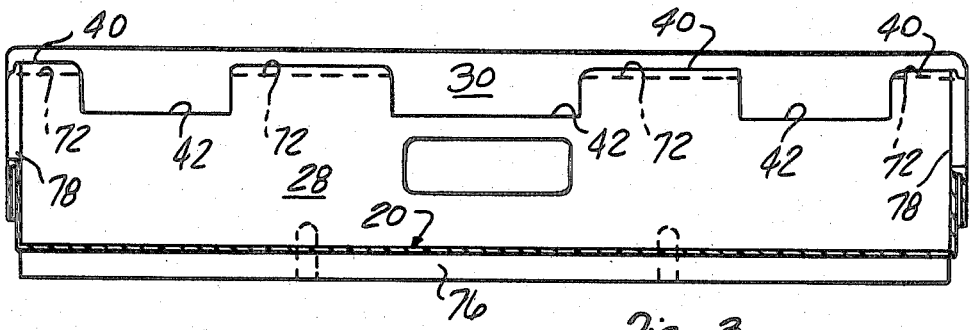
FIG. 3 is a detailed cross-sectional view showing the inner side of the end wall of FIG. 2, taken on line 3—3 of FIG. 1.

The construction of end wall 22 is best seen in FIGS. 2, 3 and 9, FIG. 2 being a view of the outer side of end wall 22, FIG. 3 being a view of the inside of end wall 22, while FIG. 9 is a cross-sectional view of two end walls 22, 22' of two containers stacked in one stacking relationship.

Referring first to FIG. 9, end wall 22, although illustrated as a single, one-piece structure, may be best described as being made up of several component portions, the first of these being identified as an inner web 28 which lies in a first vertical general plane GP1 indicated in FIG. 9. An upper outer web 30 lies in a second vertical general plane GP2 spaced outwardly from the general plane GP1 of inner web 28. An outer lower web 32 lies in a third vertical general plane GP3 offset slightly inwardly from the general plane of the upper outer web 30 so that, as best seen in FIG. 9, when two containers are stacked in like end wall to like end wall relationship, the outer lower web 32' of the upper container will fit inside the outer upper web 30 of the lower container. The three webs described above are joined to each other as by integral body portions 34, 36.

Referring now to FIGS. 2 and 3, it is seen that the outer upper web 30 has a continuous horizontal upper edge 38 which, as best seen in FIG. 3, is projected slightly upwardly above the uppermost edge portions of inner web 28. The upper edge of inner web 28 is formed with alternate raised and lowered edge sections 40 and 42, respectively. The raised edge sections 40 are horizontally aligned with each other, as are the lowered edge sections 42.

Referring now to FIG. 2, the outer lower web 32 is not continuous, but is instead formed with two end sections 32A and two intermediate sections 32B whose lower edges 44A, 44B are all horizontally aligned with each other. The intermediate webs 32B are formed with vertical slots 46, whose purpose will be described below.

From a comparison of FIGS. 2 and 3, it will be seen that the outer lower web sections 32A and 32B are respectively coextensive with the endmost raised edge portions 40 of inner web 28, while the lowered edge sections 42 of inner web 28 are coextensive with the spaces between the various outer lower web sections 32A, 32B. A continuous horizontal flange 48 (FIGS. 2 and 9) extends along the tops of outer lower web sections 32A, 32B, projecting outwardly into underlying relationship with the outer upper web 30, as best seen in FIG. 9.

Figure 4:
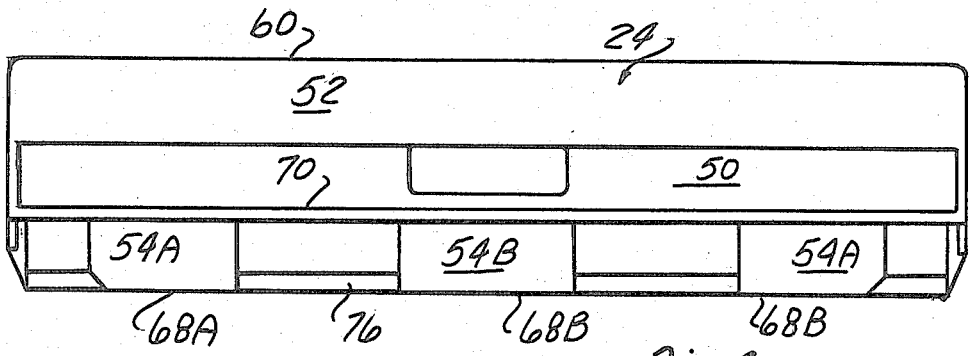
FIG. 4 is a side view of the outer side of the second end wall of the container of FIG. 1, taken from the plane 4—4 of FIG. 1.
Figure 5:
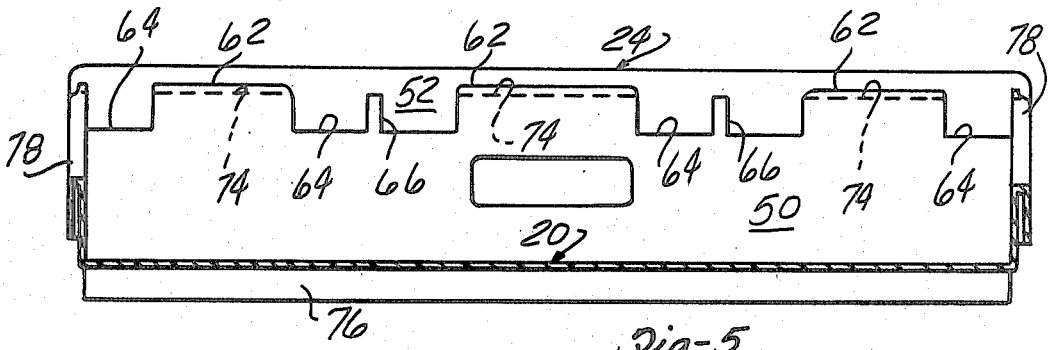
FIG. 5 is a detailed cross-sectional view showing the inner side of the end wall of FIG. 4 taken on line 5—5 of FIG. 1.

Referring now particularly to FIGS. 4, 5 and 10, the opposite end wall 24 may likewise be described as being formed with an inner web 50 lying in a vertical general plane GP4, an upper outer web 52 lying in a parallel vertical general plane GP5, and an outer lower web 54 lying in a third general vertical plane GP6. The relationship of the general planes GP4, GP5 and GP6 is the same as the relationship between the general vertical planes GP1, GP2 and GP3 of end wall 22. The various webs 50, 52 and 54 are similarly integrally joined to each other as by intermediate body portions 56, 58.

Referring now to FIGS. 4 and 5, it is seen that the upper outer web 52 of end wall 24 is formed with a continuous horizontal upper edge 60 which projects upwardly slightly above the top of inner web 50. The upper edge of inner web 50 of end wall 24 is formed with alternate raised and lowered sections 62, 64, the edges 62 being horizontally aligned with each other, as are the lowered edge sections 64. Vertically extending posts 66 formed on inner web 50 project upwardly from the midpoint of the two centrally located lowered edge sections 64 of inner web 50.

Referring now to FIG. 4, it is seen that the outer lower web sections are not continuous and are constituted by separated end sections 54A and a central section 54B having horizontally aligned lower edges 68A, 68B. As was the case with end wall 22, the outer lower web sections 54A, 54B are respectively coextensive with the raised upper edge sections 62 of the inner web of end wall 24. A horizontal flange 70, corresponding to the horizontal flange 48 of end wall 22, extends along the upper portions of web sections 54A, 54B, see also FIG. 10.

From a comparison of FIGS. 2–5, it is seen that the various raised edge sections of end wall 22 are coextensive or laterally aligned with the lowered edge sections of end wall 24 and vice versa.

Both end walls 22 and 24 find the raised edge sections of the respective inner webs 28, 50 projecting slightly above the horizontal surface of the adjacent main body portions 34 and 58, respectively, to define grooves 72, 74, see FIGS. 3, 5, 9 and 10.

Figure 7:
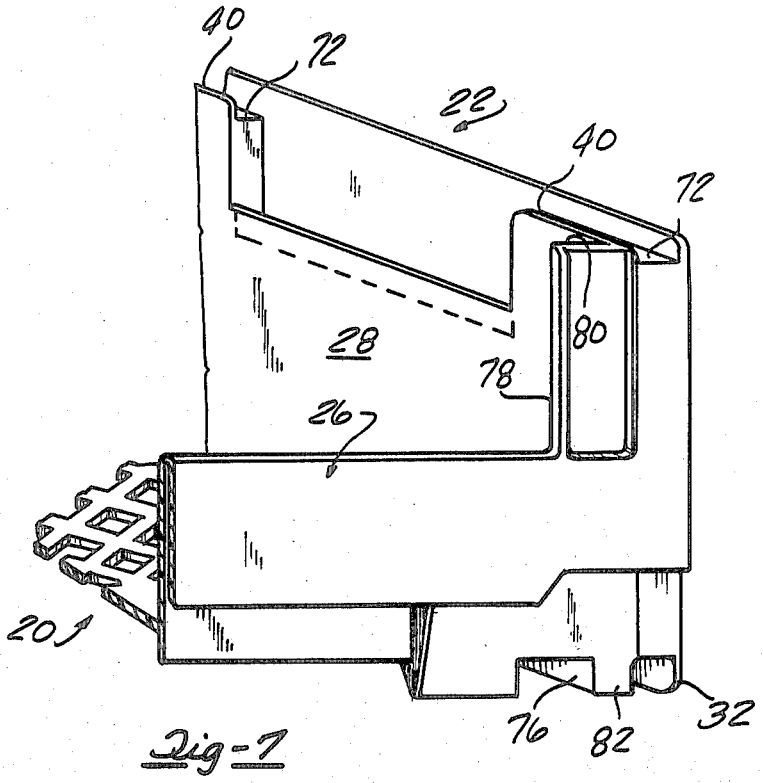
FIG. 7 is a detailed perspective view showing a corner portion of the container of FIG. 1.

To assist in sliding one container into a stacked relationship with another container, a continuous rail 76 is formed on bottom 20 just inwardly of the inner surface of inner web 28 to extend along the bottom in parallel relationship to the adjacent end wall. At each end of each side rail 26, as perhaps best seen in FIG. 7, an integral upwardly extending post 78 is formed at the juncture of side wall 26 with the respective end walls 22 and 24. The inner side surface 80 of post 78 lies in a vertical general plane which is offset slightly outwardly of the end surface 82 of the rails 76 so that when two containers are stacked one upon the other, the rails 76 fit reasonably snugly between the surfaces 80 at the opposed ends of the end wall to prevent transverse movement of the containers from their vertically aligned, stacked relationship. This retention is primarily functional when the two containers are stacked in their upper stacked position, as shown in section in FIGS. 9 and 10, since the grooves 72, 74 are open at each end.

Figure 6:
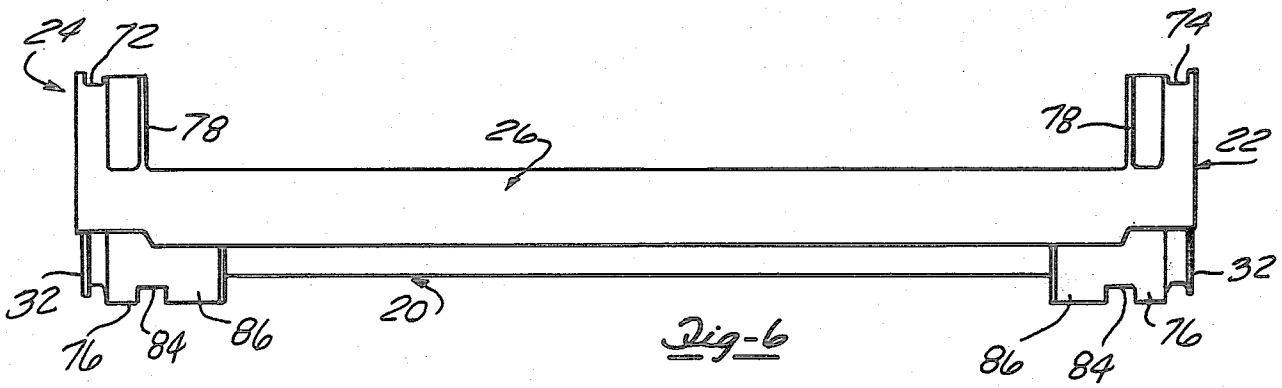
FIG. 6 is a side elevational view of the container of FIG. 1.
Figure 13:
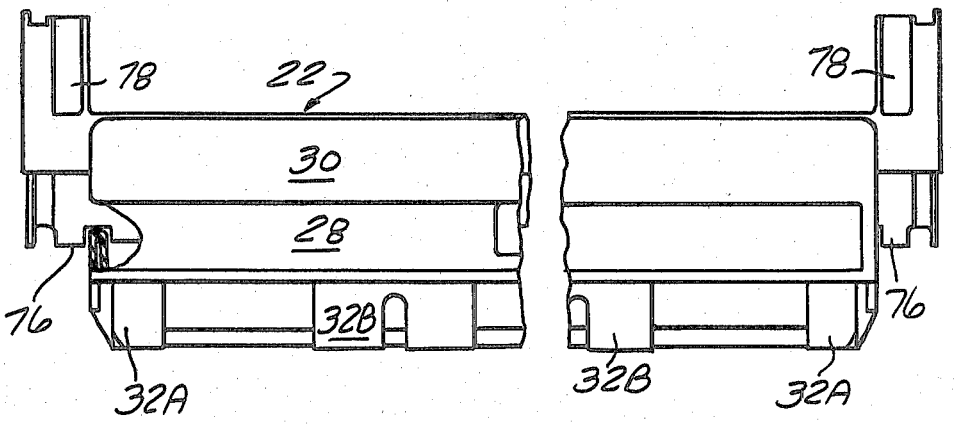
FIG. 13 is a side elevational view, with certain parts broken away, showing two containers of FIG. 1 stacked in a nested position wherein the end walls of the upper and lower containers are disposed in a crosswise or 90 degree relationship to each other.

To assist in stacking two containers in a fully nested relationship, where the upper container is disposed crosswise of the lower container, a notch 84, best seen in FIG. 6, is formed in a web 86 at the end of each side wall 26. Referring to FIG. 6, the space between the notches 84 at the opposite ends of side wall 26 is equal to the distance between side walls 26 so that, referring now to FIG. 13, when one container is stacked upon another in crosswise relationship, the notches 84 fit over the side walls 26 of the lowermost container.

Figure 8:
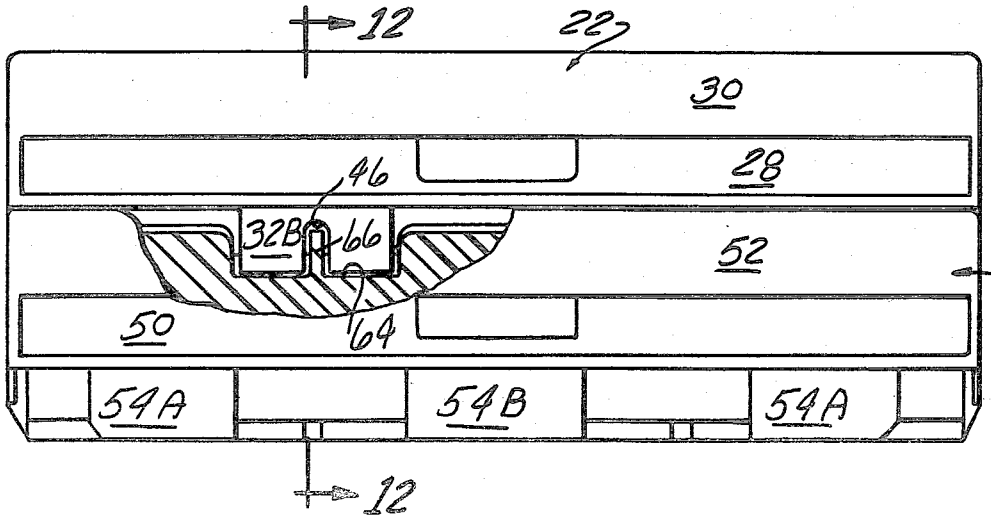
FIG. 8 is an end view, with certain parts broken away or shown in section, showing two of the containers of FIG. 1 in a low-level stacked relationship.
Figure 14:
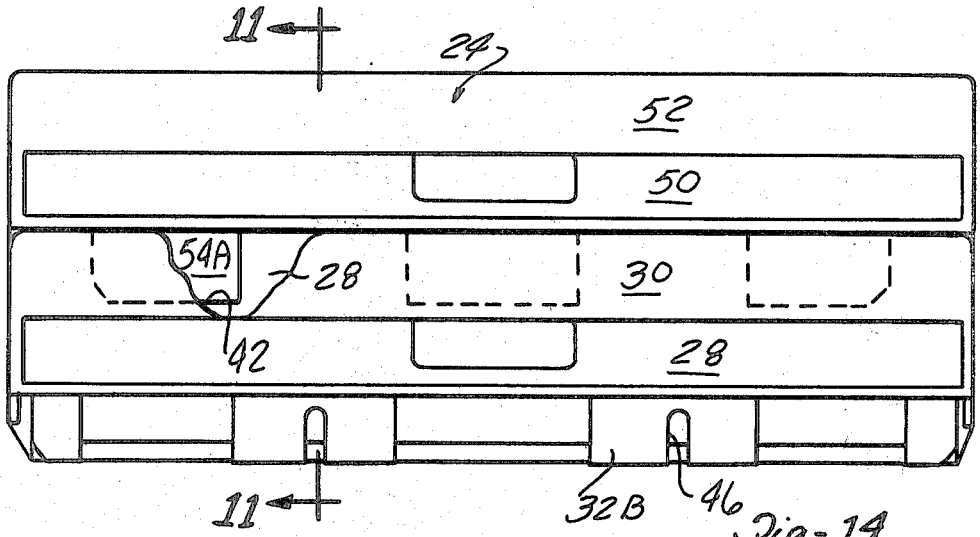
FIG. 14 is an end elevation of two containers in the intermediate-stacked position, with certain parts broken away.
Figure 15:
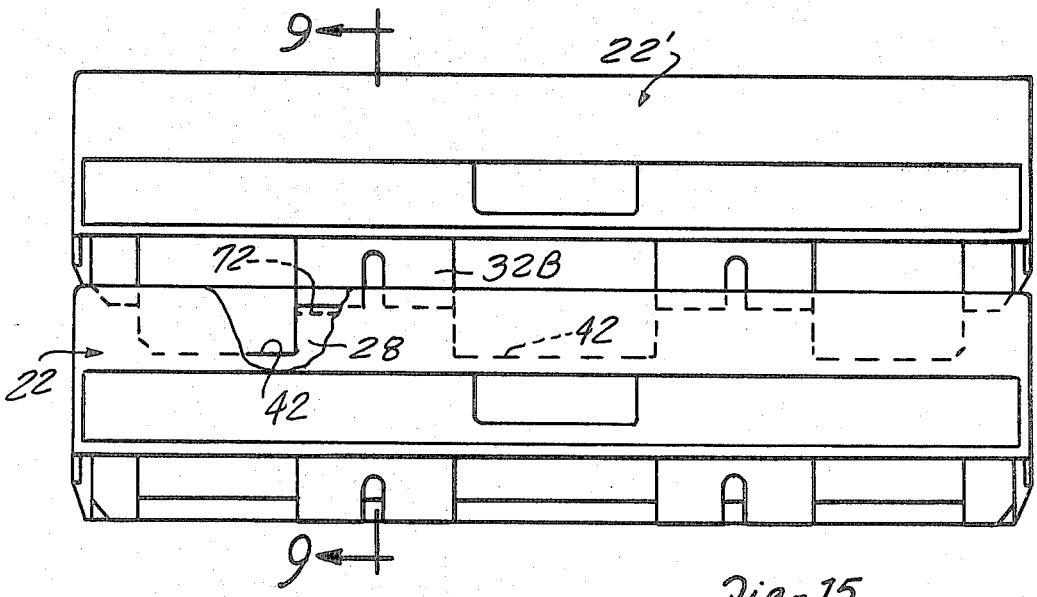
FIG. 15 is an end elevation of two containers in the high-stacked position, with certain parts broken away.

In addition to the cross-sectional views of FIGS. 9–12, end views of two containers stacked upon each other are shown in FIGS. 8, 14 and 15. FIGS. 8 and 14 respectively show opposite ends of two containers stacked in the intermediate-stacked position in like end wall to unlike end wall relationship. As best seen in FIG. 8, in this arrangement the lower web 32B of a side wall 22 of the uppermost of the two containers is received within the lowered sections 64 of side wall 24 of the underlying container, the posts 66 on the lower wall 24 being received within the vertical slots 46 of the web 32B.

Referring to FIG. 14, it is seen that in this intermediate stacked position at the opposite end of the container, the webs 54A, etc. of end wall 24 of the upper container are received in the lowered sections 42 on end wall 22 of the lower container.

FIG. 15 shows two containers stacked in the high-level stacked relationship in like end wall to like end wall relationship (in this case only the end wall 22 relationship of the two containers is shown with the upper of the two containers having its end wall designated 22'). The webs 32B' are supported upon the support platforms 72 of the lower container.

While one embodiment of the invention has been described in detail, it will become apparent to those skilled in the art that the disclosed embodiment may be modified. Therefore, the foregoing description is to be considered exemplary rather than limiting, and the true scope of the invention is that defined in the following claims.

We claim:

1. In a multilevel stacking container adapted to be stacked upon a like container at any one of a plurality of different levels relative thereto, said container including a rectangular bottom, a pair of opposed side walls projecting upwardly from opposite sides of said bottom, and first and second end walls projecting upwardly from the opposed ends of said bottom;

the improvement wherein each of said end walls comprises an inner web fixedly secured along its lower edge to the associated end of said bottom and lying in a first vertical general plane, said inner web having a horizontal upper edge interrupted by uniformly spaced recesses each defined by opposed vertical side edges extending downwardly a uniform distance from said upper edge to a horizontal edge defining the bottom of the recess whereby the top of said inner web is defined by alternate raised and lowered horizontal edge sections, an outer upper web lying in a second general plane parallel to and offset outwardly from said first vertical plane, said outer upper web having a continuous horizontal upper edge projecting upwardly above the raised edge sections of said inner web, a series of spaced lower outer web sections lying in a third general plane parallel to and located between said first and said second general planes and having horizontally aligned horizontal lower edges projecting downwardly below said bottom, means securing the aforementioned webs and web sections to each other with said outer web sections located in coextensive relationship along said end wall to said raised edge sections of said inner web, said means securing including means defining a horizontal platform extending between said inner and said upper outer webs coextensive with and slightly below the top of each of said raised edge sections, the raised edge sections of said first end wall being located directly opposite the lowered edge sections of said second end wall, means defining a relatively narrow vertical slot extending upwardly from the lower edges of at least two of said lower outer web sections of said first end wall, and locater posts on said inner web of said second end wall complementary in shape to said slots and projecting upwardly from at least two coextensive lowered edge sections of the last mentioned inner web, said posts having horizontal upper edges horizontally aligned with the upper surfaces of said platform.

2. The invention defined in claim 1 further comprising a flange on each end wall fixedly secured to and extending horizontally along the outer side of said inner web across the spaces between and along the top of each of said lower outer web sections and projecting outwardly beyond said web sections to intercept said second general plane.

3. The invention defined in claim 1 wherein said lower edges of the outer lower web sections adjacent said side walls each have an upwardly inclined bevel at that end of the lower edge adjacent the associated side wall.

4. The invention defined in claim 1 further comprising a continuous rail fixedly mounted on the underside of said bottom adjacent each end thereof, said rail being located inwardly of said first general plane so that the outer side of the rail of one container will be in adjacent, face-to-face relationship with the inner side of the inner web of a like container when said one container is stacked on said like container with the end walls of said one container overlying the end walls of said like container, a post section fixedly mounted at each end of each of said side walls and fixedly secured to the inner web of the adjacent end wall, each post section having a vertical inner side abutment surface, each of said rails terminating at its opposite ends at a vertical end surface lying in a vertical general abutment plane spaced slightly inwardly of said container from the general plane of the side abutment surface of the overlying post section.

* * * * *